United States Patent [19]

Kelp

[11] 4,036,021

[45] July 19, 1977

[54] POWER PLANT INCLUDING A COOLING TOWER SURROUNDING THE POWER PLANT SITE

[75] Inventor: Fritz Kelp, Erlangen, Germany

[73] Assignee: Kraftwerk Union Aktiengesellschaft, Mulheim (Ruhr), Germany

[21] Appl. No.: 566,398

[22] Filed: Apr. 9, 1975

[30] Foreign Application Priority Data

Apr. 9, 1974 Germany ..... 2417290

[51] Int. Cl.[2] ..... F28B 1/06

[52] U.S. Cl. ..... 60/692; 165/DIG. 1; 290/2; 165/129

[58] Field of Search ..... 165/DIG. 1, 47, 129, 165/125; 60/690–693; 261/DIG. 11; 290/2

[56] References Cited

U.S. PATENT DOCUMENTS

| | | | |
|---|---|---|---|
| 3,171,258 | 3/1965 | Caldwell et al. | 60/688 |
| 3,296,450 | 1/1967 | Johnson | 290/2 |
| 3,434,529 | 3/1969 | Daltry | 165/125 X |

FOREIGN PATENT DOCUMENTS

| | | | |
|---|---|---|---|
| 1,130,946 | 10/1956 | Germany | 165/DIG. 1 |

*Primary Examiner*—Albert W. Davis, Jr.
*Attorney, Agent, or Firm*—Herbert L. Lerner

[57] ABSTRACT

A power plant, especially a nuclear power plant, is positioned within the interior of a double walled dry cooling tower, the cooling tower having its own foundation and encompassing the power plant site. The inner and outer walls of the cooling tower are adapted to form a relatively small ring zone as compared to the basis area of the power plant, said ring zone having a cooling air entrance at the lower end of the outer wall and an exit at its upper end. Within the ring zone, at its lower end, there are arranged cooling elements of heat exchangers, being exposed to the upwardly flowing cooling air stream. Through this arrangement the break in of cool winds or cool air, otherwise flowing reversely to the cooling air stream, from the exterior via the exit, is prevented.

6 Claims, 2 Drawing Figures

POWER PLANT INCLUDING A COOLING TOWER SURROUNDING THE POWER PLANT SITE

This invention relates to a power plant having its essential buildings and equipment located within the interior of a so called dry cooling tower. Cooling towers of this kind are disclosed by the inventor in the magazine "Elektrizitatswirtschaft" of November 1964, pages 824 to 831. Typical for the cooling towers according to the state of the art (see especially FIG. 11 on page 6 of the mentioned publication) is, that the cooling air enters the cooling tower through entrance openings of its wall, the cooling air after being heated by the waste heat of the power plant leaving the cooling tower in the upward direction. The whole interior area of the cooling tower defined and encompassed by its wall thereby serves as duct for the cooling air. Economically feasible is only a low degree acceleration of the cooling air by venting or blower means, and therefore a relatively large cross sectional area is required for guiding the cooling air. In case one chooses to have a cooling tower building which encompasses the power plant rather narrowly, the height of the cooling air entrance openings amounts to 50 meters and more. Consequently, the corresponding buildings and devices for the heat exchange had to be arranged at such a height.

In case one chooses to increase the diameter of the cooling tower without any additional measures in order to reduce the entrance height for the cooling air, consequently, a relatively large cross sectional area for the cooling air exit at the upper edge of the cooling tower had to be provided. Such large cross sectional exit areas have the disadvantage that environmental air can penetrate or pass in through the exit opening of the cooling tower on its side adjacent the direction of the wind causing substantial losses in cooling power by reducing the cooling tower draft. A further disadvantage of the heretofore known power plants with dry cooling tower is that the airconditioning of the power plant buildings is problematic due to the fact that the fresh cooling air first passes the heat exchangers before being guided to the power plant buildings proper. Furthermore, the erection of a cooling tower surrounding the essential buildings of a power plant narrowly is not independent of the erection of the power plant buildings itself, this being desirable especially with regard to large power plants and particularly to nuclear power plants where construction time is very expensive.

With a view to solving the above problems, it is an object of the present invention to provide a novel and improved power plant with its cooling tower encompassing the essential buildings and parts of the power plant, where a reduction of effectivity and cooling power by the penetration of cool environmental air through the cooling tower exit, thereby disturbing the upwardly flowing cooling air, is avoided.

Another object of the present invention is to provide an arrangement of the power plant and its cooling tower, wherein the foundations and constructions of the essential power plant buildings and the cooling tower, respectively, can be erected independently of each other.

A further object of the present invention is to provide an arrangement for the power plant and its cooling tower, which is advantageous with regard to the leading of fresh environmental air directly to the power plant buildings, thereby facilitating the air-conditioning.

The above and other objects, features and advantages of the present invention will be apparent from the following description taken in conjunction with the accompanying drawing.

Figure 1:
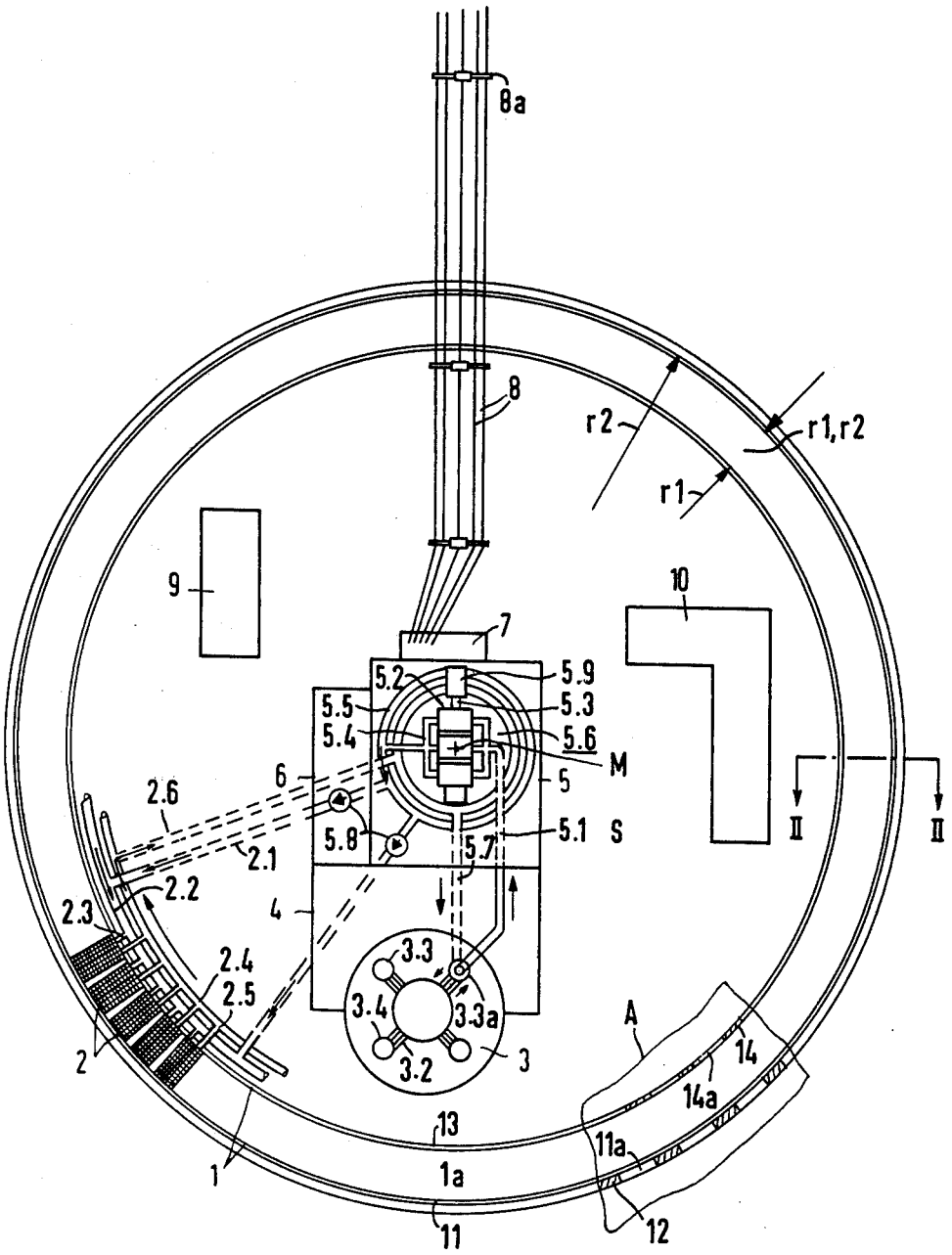
FIG. 1 is a plan view of the power plant showing schematically the arrangement of the power plant buildings and the corresponding cooling tower.

In FIG. 1 of the drawing there is shown the plan view from above of a tubular shaped cooling tower 1 having an inner wall 13 and having an outer wall 11, the latter defining the exterior of the cooling tower and being arranged substantially in parallel relationship and spaced with respect to the inner wall 13. By the inner and outer walls 13, 11 there is formed a substantially annular channel 1 a being described more in detail in conjunction with FIG. 2 hereinafter. Cooling elements 2 of heat exchangers cooperating with and inserted within the closed loop means of the power plant are arranged within the annular channel 1*a*, there only being depicted 5 cooling elements 2. However, it is to be understood that a multiplicity of cooling elements one after another in circumferential sequence are to be arranged within the annular channel. Within the interior of the cooling tower 1 there is located an arrangement of power plant buildings located at the power plant site S and including the essential buildings of a nuclear power plant. Although it is to be understood that a power plant of any suitable kind can be located at the site S, it is particularly advantageous, according to the invention, to have a nuclear power plant arrangement, as hereinafter explained in more detail. The arrangement includes a nuclear reactor building 3, an auxiliary station building 4, the machinery building 5, the switching station block 6 and the main block transformer 7. The main block transformer 7 is connected to an electrical main output power line 8, which is passed through the walls 11, 13 of the cooling tower 1 and connected to an external high voltage network system not shown. The masts carrying the high voltage line 8 are designated 8*a*. The ancillary buildings 9 and 10, respectively, contain auxiliary equipment and offices for the power plant staff. The blocks or buildings 3, 4, 5, 6 and 7 form the central power station block and are attached to each other as shown. The blocks 9 and 10 are separate constructions.

Figure 2:
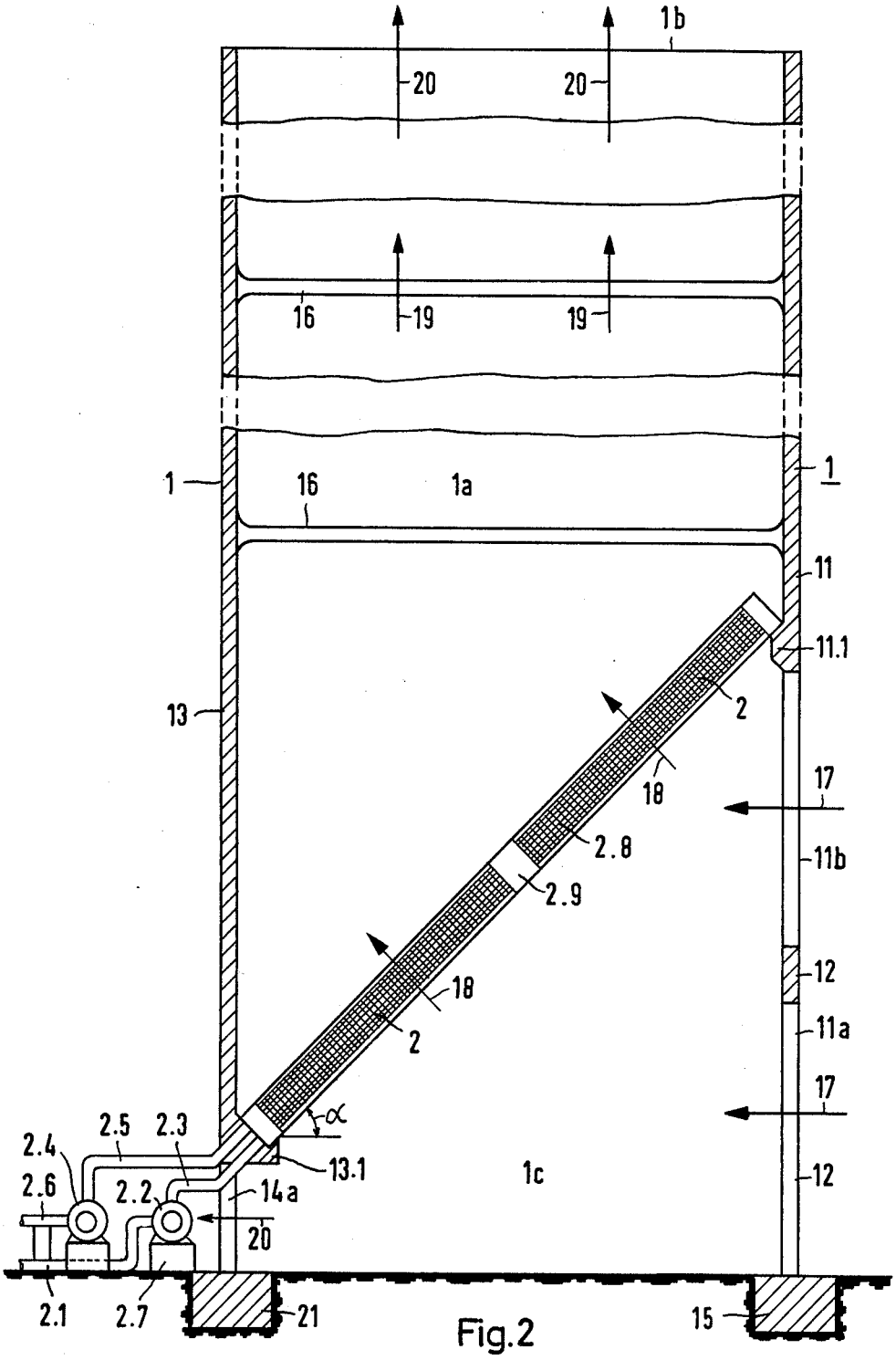
FIG. 2 is a schematic vertical section being taken on the line II—II of FIG. 1 showing one cooling element and the corresponding cooling tower construction, the intermediate portion being broken away because not essential for understanding the present invention.

As shown in FIG. 2, the outer wall 11 is supported by supporting columns 12, the latter resting on the foundation 15. The columns 12 are circumferencially spaced to each other to form fresh air inlet openings 11*a* and 11*b*, said openings 11*a*, 11*b* being uniformly distributed in horizontal direction, respectively, within two rows one row above the other, as shown. The inner wall 13 is supported by supporting columns 14, these inner columns 14 resting on a corresponding foundation 21. The inner wall and the outer wall 13, 11 are connected by enforcing bridging struts 16 arranged in radial direction and having a cross sectional shape (not shown) of low flow resistance. The struts 16 are arranged within several levels one above the other, only two strut rows being shown in FIG. 2. The inner and outer wall 11, 13 together with their foundation 15, 21 and their bridging struts 16 form a stable and stiff cooling tower construction, able to withstand all weather conditions, the cooling tower construction having a sufficient height to provide for the necessary cooling air draft. Depending on the size of the power station the height of the cooling tower amounts in the range of 80 to 200 meters, approximately. The supporting columns 14 are spaced to each other and distributed uniformly and in circumferential direction to form fresh air inlet passageways 14*a* for the power plant site S. The arrangement for the supporting columns 12, 14 and the associated openings and passageways 11*a*, 14*a* is indicated schematically within the area A of FIG. 1. As mentioned, the intermediate portion of the cooling tower 1 is not shown in FIG. 2. The upper end 1*b* of the cooling tower 1 serves as an exhaust or exit for the heated cooling air entering the cooling tower through its lower end 1*c*.

The cooperation of the power plant blocks and elements becomes apparent from FIG. 1. The nuclear reactor building 3 houses a nuclear reactor 3.1 which is a PWR (pressurized water reactor) using light water as moderator and cooling liquid. The light water is circulated as primary coolant within a primary circuit comprising the reactor 3.1, outlet pipes 3.2, steam generators 3.3 and inlet pipes 3.4, the light water being conveyed by pumping means not shown, thereby cooling the reactor core and transferring its heat through the heat exchanger means of the steam generator 3.4 via the walls of the heat exchanging tubes of the latter. In FIG. 1 four steam generators 3.3 are shown forming a portion of the primary loop, the secondary loop only being indicated for the steam generator 3.3*a*. The secondary loop comprises: outlet pipes 5.1 leading the steam from the steam generators 3.4 towards the inlet of the turbine set 5.2, said turbine set 5.2 converting the energy of the live steam into mechanical energy of the rotating turbine shaft 5.3, the turbine exhaust pipes 5.4, being connected to a first center ring pipe system 5.5, a first connection pipe system 2.1 connecting the first center ring pipe system 5.5 to a first peripheral ring pipe system 2.2, the cooling elements 2 being connected with their inlet pipes 2.3, respectively, to said first peripheral ring pipe system 2.2, a second peripheral ring pipe system 2.4 connected to the exits of the cooling elements via outlet pipes 2.5, respectively, second connection pipes 2.6 connecting the second peripheral ring pipe system 2.4 to a second center ring pipe system 5.6, and finally an inlet pipe 5.7 connecting the second center ring pipe system 5.6 to the inlet of the steam generators 3.4. Furthermore the secondary loop comprises pumping means 5.8 circulating the water used as working medium within the secondary loop. The electrical generator driven by the turbine set 5.2 is designated 5.9 and the electrical energy induced by the generator 5.9 is led towards the block transformer 7 via electrical lines not shown. Within the secondary closed loop, the working fluid is heated by the steam generators 3.4 transferring the heat of the primary fluid, is pressurized by the pumping means 5.8, expands within the stages of the turbine set 5.2 and is cooled down within the heat exchanger means of the cooling elements 2. The turbine condenser, located below the turbine set 5.2, is not shown, although it is to be understood that the working fluid flows from the exhaust pipes 5.4 to the condenser before entering the first center ring pipe system 5.5. Preferably, so called indirect air cooled condensing systems (Heller system) are used as disclosed per se in the above-mentioned article of the magazine "Elektrizitatswirtschaft," especially FIG. 3 on page 825 thereof. This is advantageous, because the water, after being cooled down within the injection condenser, has a relatively low temperature and hence only a portion of the condensed steam has to be transported towards and from the cooling elements 2, the remaining portion of the condensed steam being used for direct feeding of the steam generators 3.4. The preferred embodiment of the cooling tower is a tubular shaped one, as shown in FIG. 1, it being understood that the invention is not limited to a tubular shaped cooling tower, but encompasses a poly-gone shaped cooling tower as well. The peripheral line systems 2.2 and 2.4 are shaped depending on the form of the cooling tower walls. Only a section of these peripheral ring pipe systems and the connecting pipes 2.1 and 2.6 is shown, because the remaining pipe systems are similar and their illustration is not essential for understanding the present invention.

Referring now to FIG. 2 again, the same reference numerals as in FIG. 1 belong to the same parts. The first and second peripheral ring pipe systems 2.2 and 2.4, respectively, are supported by suitable supporting spacers 2.7. The cooling elements 2 are arranged in a duplex or dual arrangement, the tube system 2.8 thereof being held by a supporting frame 2.9, the latter being supported by projections 11.1 of the outer wall 11 and 13.1 of the inner wall 13, respectively. As shown, the cooling elements 2 are arranged in an inclined position, the angle of inclination $\alpha$ being approximately 45 degrees, so that the fresh cooling air entering the cooling tower via the entrance openings 11*a*, 11*b* according to the arrows 17 defines an enlarged area of the cooling surface of the cooling elements 2 exposed to the air stream. The passing of the cooling air is indicated by arrows 18. After a deflection of about 90° along its way through the cooling elements the air stream flows upwardly through the annular channel or ring zone 1*a* as indicated by arrows 19 and finally leaves the ring zone 1*a* via the exit or exhaust 1*b* of the cooling tower, as indicated by arrows 20. Along its way at 17 it has a low environmental temperature, it is then heated up while passing the cooling elements 2 and finally leaves the exit 1*b* as relatively warm air. A smaller portion of the fresh cooling air is bypassed through the air inlet passageways 14, as indicated by arrow 21, and led from there directly to the interior of the power plant buildings for air-conditioning purposes, leaving the buildings through the central area in upward direction. This is especially suitable for warmer regions, whereas it is to be understood, that in colder regions a portion of the air led towards the power plant buildings could be warmed up by the cooling elements 2. In FIG. 2 there are not shown any blower or venting means for the cooling air. Depending on the height of the cooling tower the natural draft may suffice. However, it is to be understood, that such blower or venting means comprising fans driven by electric motors could easily be arranged below the cooling elements within the entrance area 1*c*. According to the preferred embodiment shown, the inner wall 13 and the outer wall 11 are vertical in order to have a practically uniform cross sectional area in the direction of flow. The walls 11, 13 are made of enforced concrete, but a steel construction may be used as well.

Referring again to FIG. 1, it is apparent that the exhaust steam pipes 5 and 4, and similarly the first and second center ring pipe systems 5.5, 5.6, respectively, are positioned adjacent the center point M of the power plant site so as to have the coolant inlet and outlet pipes 2.6, 2.1, also called connection pipes, substantially equidistant. It will be appreciated that by this means the thermal expansion and contraction of the connection pipes is practically uniform.

The outer wall 11 has a distance $r_2$ from the center point M, which is larger than the distance $r_1$ of the inner wall 13 from the center point M. The distance between the inner and outer wall 13, 11 is designated $r_{1,2}$. This width is relatively small so as to form a ring zone 1 a being relatively small as compared to the base area of the power plant site S, thereby preventing the break in or penetration of cold air and winds through the exit 1*b* (see FIG. 2) otherwise flowing reversely to the upwardly flowing cooling air stream, especially under stormy weather conditions. Depending on the size of the power plant site the width $r_{1,2}$ amounts approximately within the range of 1/5 to 1/10 of the radius $r_2$. It will be appreciates that, nevertheless, the cross sectional area of the ring zone 1*a* is large enough to form a low resistance channel for the cooling air. Furthermore the foundations 21 and 15 of the inner and outer wall 13, 11 can be erected independently of the foundations of the power plant buildings, thereby rendering it possible to construct and erect the respective foundations and walls independently of each other, this being appreciated with regard to the lengthy construction time of nuclear power plants in particular. The disclosed power plant is especially suitable in areas where a water scarcity or shortage exists or the water of existing reservoirs must not be used because of undesirable temperature increase of the water. So using the preferred embodiment of a nuclear power plant serves to avoid pollution in a double sense, avoiding exhaust gases of stacks or chimneys and the thermal pollution of river water, thus preserving fish life.

What is claimed is:

1. Power plant for converting primary energy into electrical energy including closed loop means for heating, pressurizing, expanding and cooling down a working fluid, which comprises:

a. an arrangement of power plant buildings located at the power plant site and including at least a central power station block;

b. a dry cooling tower having an inner wall being spaced with respect to and encompassing at least partially said arrangement and having an outer wall defining the exterior of said cooling tower and being arranged substantially in parallel relationship and spaced with respect to said inner wall, said inner and said outer wall defining a substantially annular channel having an air inlet at its lower end and an air exit at its upper end, said air inlet being formed by air inlet openings at the lower end of said outer wall, so that the cooling air entering said channel through said inlet openings flows upwardly through said channel towards said exit, said inner and said outer wall having a separate foundation erectable independently of the foundation of said arrangement;

c. heat exchanger means for cooling down the working fluid comprising cooling elements located within said channel and being exposed to said cooling air stream, said elements being connected to inlet and outlet pipes, said inlet pipes supplying the working fluid to be cooled down from said arrangement to said elements and said outlet pipes discharging the working fluid after being cooled down from said elements to said arrangement; said air inlet openings guiding the incoming air across the surface of said cooling elements and therefrom upwardly towards said exit thereby dissipating the waste heat of said working fluid;

said inner and said outer wall being arranged substantially concentrically to a center point of said site and having a distance $r_1$, $r_2$, respectively, from said center point and a distance $r_{1,2}$ from each other so as to form a ring zone the width of which being relatively small as compared to the basis area of the power plant site, so as to prevent the break in of cold air and winds through the exit otherwise flowing reversely to the upward cooling air stream.

2. The combination of claim 1, wherein the inner wall is provided with fresh air inlet passageways to form a bypass duct for a portion of fresh air being guided via the inlet openings of the outer wall, a channel section below the cooling elements and said inner wall passageways directly to the interior of the buildings of said arrangement and from there to the exterior.

3. The combination of claim 2, wherein the inner wall is born by supporting columns forming said passageways therebetween.

4. The combination of claim 1, wherein said inner wall and said outer wall are vertical.

5. The combination of claim 1, wherein turbines are used as prime movers and the exhaust steam pipes of the turbines are located adjacent the center point of the power plant site so as to have the coolant inlet and outlet pipes substantially equidistant.

6. The combination of claim 1 wherein the power plant is a nuclear power plant.

* * * * *